US009738364B2

(12) United States Patent
Abney

(10) Patent No.: US 9,738,364 B2
(45) Date of Patent: Aug. 22, 2017

(54) HULL-MOUNTABLE RETRACTABLE THRUSTER APPARATUS AND METHOD

(71) Applicant: Kenneth Abney, Carriere, MS (US)

(72) Inventor: Kenneth Abney, Carriere, MS (US)

( * ) Notice: Subject to any disclaimer, the term of this patent is extended or adjusted under 35 U.S.C. 154(b) by 19 days.

(21) Appl. No.: 14/996,301

(22) Filed: Jan. 15, 2016

(65) Prior Publication Data

US 2017/0203823 A1 Jul. 20, 2017

(51) Int. Cl.

| | |
|---|---|
| ***B63H 5/125*** | (2006.01) |
| ***B63H 11/02*** | (2006.01) |
| ***B63H 25/42*** | (2006.01) |
| ***B63H 21/30*** | (2006.01) |

(52) U.S. Cl.

CPC ..... *B63H 5/125* (2013.01); *B63H 11/02* (2013.01); *B63H 21/30* (2013.01); *B63H 25/42* (2013.01)

(58) Field of Classification Search

CPC ..... B63H 5/125; B63H 11/02; B63H 25/42; B63H 21/30

See application file for complete search history.

(56) References Cited

U.S. PATENT DOCUMENTS

| | | | | |
|---|---|---|---|---|
| 4,129,088 | A * | 12/1978 | Foley, Jr. | B63H 20/007 248/640 |
| 4,294,186 | A * | 10/1981 | Wardell | B63H 25/42 114/151 |
| 4,878,864 | A | 11/1989 | Van Bentem | |
| 6,056,610 | A | 5/2000 | Fontanille | |
| 6,357,375 | B1 | 3/2002 | Ellis | |
| 6,375,524 | B1 | 4/2002 | Commandeur et al. | |
| 6,592,412 | B1 * | 7/2003 | Geil | B63B 1/042 114/144 E |
| 7,146,921 | B2 | 12/2006 | Fontanille et al. | |

* cited by examiner

*Primary Examiner* — Stephen Avila

(74) *Attorney, Agent, or Firm* — Keaty Law Firm, LLC

(57) ABSTRACT

The present invention(s) relates to a structure and method for improved auxiliary thruster systems for marine and small vessels, including small fishing and pontoon boats. Under conditions of wind or rough waters it may be impracticable to employ the main drive of a vessel because it may provide more thrust and motility than needed and may not be fuel efficient for such purposes. The present invention(s) relates to auxiliary thrusting and maneuvering systems of marine vehicles which may be employed in addition or independently of main propulsion of the vehicle or craft that protracts and retracts a thruster assembly.

8 Claims, 6 Drawing Sheets

HULL-MOUNTABLE RETRACTABLE THRUSTER APPARATUS AND METHOD

BACKGROUND OF THE INVENTION

The present invention(s) relates to a structure and method for improved auxiliary thruster systems for marine and small vessels, including small fishing and pontoon boats. Particularly, the invention(s) relates to auxiliary thrusting and maneuvering systems that protract and retract a trolling motor assembly and can be used in marine vehicles in addition to, or independently of, the main propulsion of the vehicle or watercraft.

Trolling motors are well known in the art and have been used for many years, particularly for small watercraft such as fishing boats and recreational vessels. Such a small watercraft is often lightweight and generally has a main outboard motor mounted to the boat's transom. The main motor performs as the boat's main thruster and propulsion system. Due to the lightweight nature, this small watercraft is regularly subject to being tossed about in rough waters or set adrift in strong currents, strong winds, or after a race boat speeds by, leaving choppy water or a high wake. Often, it is undesirable to employ the main outboard motor. For instance, in strong wind or rough waters it may be impracticable to employ the main drive of the vessel because it may provide more thrust and motility than needed and may not be fuel-efficient for such purposes. While traveling close to the shoreline, the main outboard motor is undesirable in some instances as it may cause unwanted waves that may frighten away fish, damage the shoreline, or pose a danger to other boaters or swimmers. Another danger of using the main outboard motor while close to the shoreline is the possibility that debris may impact the motor or become lodged into the motor.

The single thruster propulsion system also poses problems when attempting to dock watercraft. In order to dock a vessel, the vessel must be pulled up alongside the pier, slowed to a pace that will allow the driver or deckhand to grab hold of the pier either physically or by rope, sufficiently latched to the pier, and then stopped from drifting further once latched to the pier. One solution to the difficulty of docking the watercraft is that the captain, or driver, of the vessel often must employ a second person to assist them in docking the vessel as they direct and maneuver the vessel from a rear mounted main thruster. Without a second person, the driver of the vessel must steer the vessel as well as pull the vessel to the pier with a rope.

To solve these problems, those skilled in the art have long attempted to employ auxiliary propulsion systems for steering and maneuvering light-to-medium watercraft. The most problematic result of the addition of a fixed, auxiliary thruster is that the auxiliary thruster would provide drag, slowing the vessel, and add an extra element which may collect debris as the vessel travels. Additionally, for small watercraft the addition of an additional auxiliary thruster may make transferring the vessel to and from the water difficult, as the auxiliary thruster may be damaged when being pulled from the slip, or the maneuvering involved in preventing such damage would be all too unwanted. For these reasons and others, the addition of retractable or semi-retractable auxiliary thrusters have been utilized in the marine industry for many years. The known art relating to retractable auxiliary propulsion systems include two types: systems for larger marine vessels, often called a bow thruster in the known art, and the utilization of trolling motor systems utilized by smaller recreational fishing boats. The retractable propulsion systems for larger vessels employ a system for which the thruster is lowered and retracted through a compartment of the hull of the vessel. These systems are only available for larger vessels with sufficient space between the bilge of the ship and the top deck to house such an auxiliary thruster system and compartment that could be flooded upon deployment of the auxiliary thruster. These systems are unavailable to small watercraft because there is insufficient space for such a compartment.

To overcome these obstacles for small watercraft, the trolling motor has been known to the art for many years. There have been several different trolling systems used for small watercraft, all of which attempt to solve the problems discussed above. The mere number of different systems shows the industry efforts in creating a system that is easy to use and solves most of the problems previously discussed. Early in the art, some attempted to solve the problems inherent with the maneuverability of small watercraft through the use of a trolling motor mounted to the boat's transom (for example, U.S. Pat. Nos. 2,744,418 and 3,139,853).

The known art has since evolved and at present, most auxiliary propulsion systems for smaller fishing vessels are retractable and mounted on the deck of the vessel in a forward position near the bow. The thruster, usually a trolling motor, must manually be lowered into the water for operation and use of the thruster assembly, which often contains an extension arm mounted to a folding bracket employed to conserve space when in the retracted position when the vessel is being propelled at normal speeds by the main propulsion system. These systems require the driver of the vessel to leave his position at the helm to place the motor in and out of service and to control the speed and direction of propulsion. Previous incarnations of this system also required the manual adjustment of the position of the motor. Other problems that arise from the deck-mounted, bow thruster assembly design include the necessary use of valuable deck space for an idle auxiliary motor. While not being employed, the motor usually stays on the deck of the vessel and often becomes a hazard on the deck, severely restricting the personnel movement on the deck. Some systems are mounted to the bow of the vessel similarly to the mounting of the main outboard thruster located on the transom of the boat. These systems are bulky, obscure the captain's vision while navigating the vessel, and are often required to be manually deployed for service and manually steered.

Others skilled in the art have attempted to solve this problem for smaller watercraft by suggesting the use of a retractable docking line coupled to a rotatable spool used to pull the vessel to the shore or pier. This may solve the problem of docking the watercraft, but this posed solution does not address the issues of maneuverability inherent in the small watercraft construction.

As the above-referenced scenarios exhibit, a secondary thrusting system, such as is known in the art, is nearly a necessity for small watercraft, and although many auxiliary thruster systems are known to the art, all, or almost all of them suffer from one or more disadvantage. Therefore, there is a need to provide an improved design and apparatus for auxiliary thruster systems for marine vessels.

SUMMARY OF THE INVENTION

The primary objective of the invention(s) is to aid in the protracting and retracting of a propulsion device mounted to marine vessels.

One object of the invention(s) is to provide a solution to maneuverability problems inherent in a rear-mounted thruster system for watercraft.

A further object of the invention(s) is to provide a kit of a retractable thruster system that can be retrofitted to already existing vessels.

An even further object of the invention(s) is to provide a retractable thruster that can be protracted and maneuvered through controls that will not interfere with other controls necessary for the vessel's operation.

The present invention(s) is directed to a secondary thruster system mounted to the hull of a vessel below the waterline, with the secondary thruster being protracted and retracted through an actuator, and is utilized through a control system on the deck of the vessel. The present invention(s) may be fitted to the vessel during production or retrofitted after the vessel is built.

In a preferred embodiment, a digital maximizer is attached to the power supply to create efficiency for the power supply, but is not an integral part of the invention.

In a preferred embodiment, the control system directs the speed and direction of the thruster as well as the movement of the actuator through electrical connection. In another embodiment, the control system utilizes remote, wireless control of the actuator and thruster.

Various objects, features, aspects, and advantages of the present invention(s) will become more apparent from the following detailed description of preferred embodiments of the invention(s), along with the accompanying drawings in which like numerals represent like components.

BRIEF DESCRIPTION OF DRAWINGS

Reference will now be made to the drawings, wherein like parts are designated by like numerals, and wherein.

DETAILED DESCRIPTION OF THE INVENTION

Figure 1:
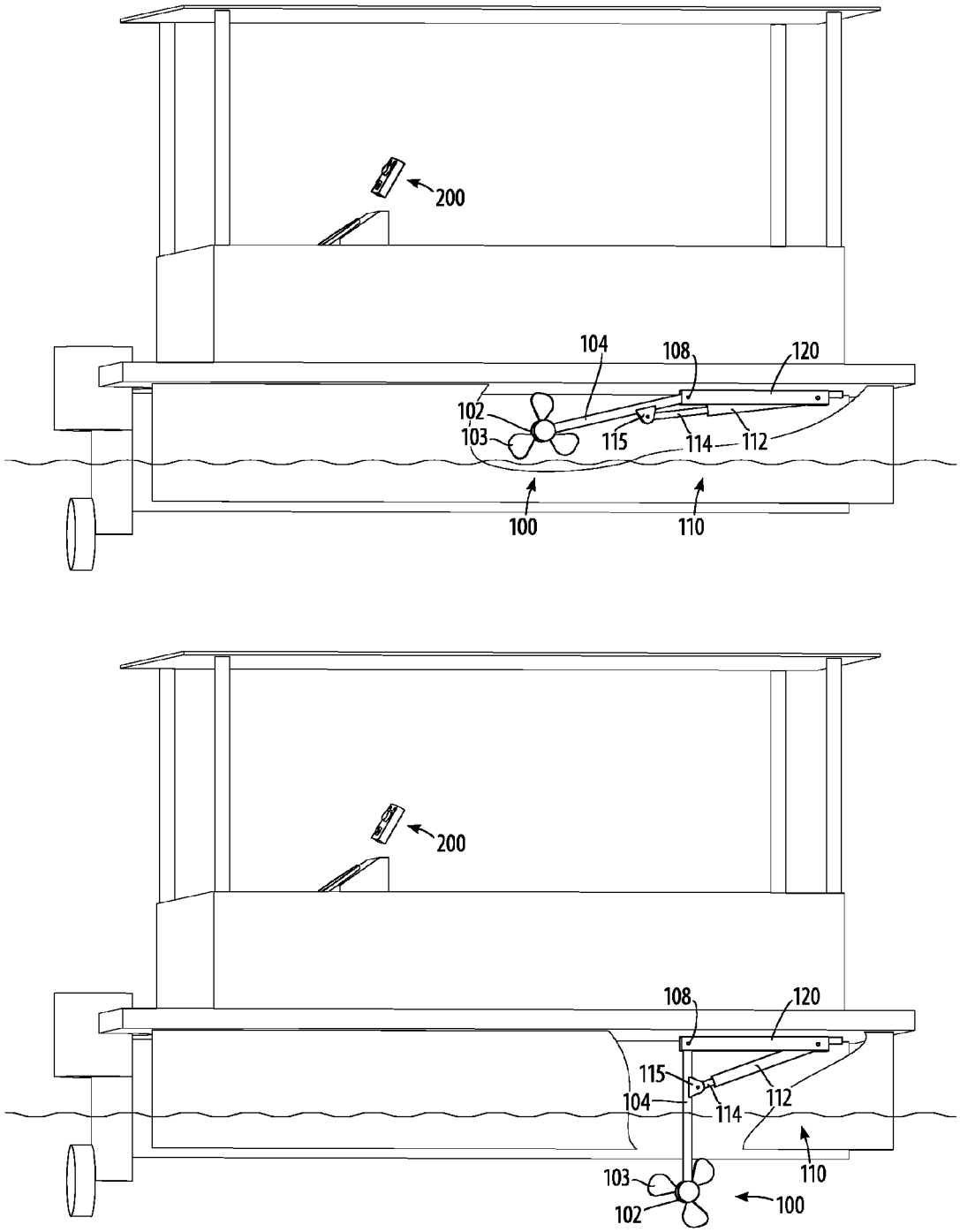
FIG. 1 is a schematic view of the hull-mounted retractable thruster.
Figure 2:
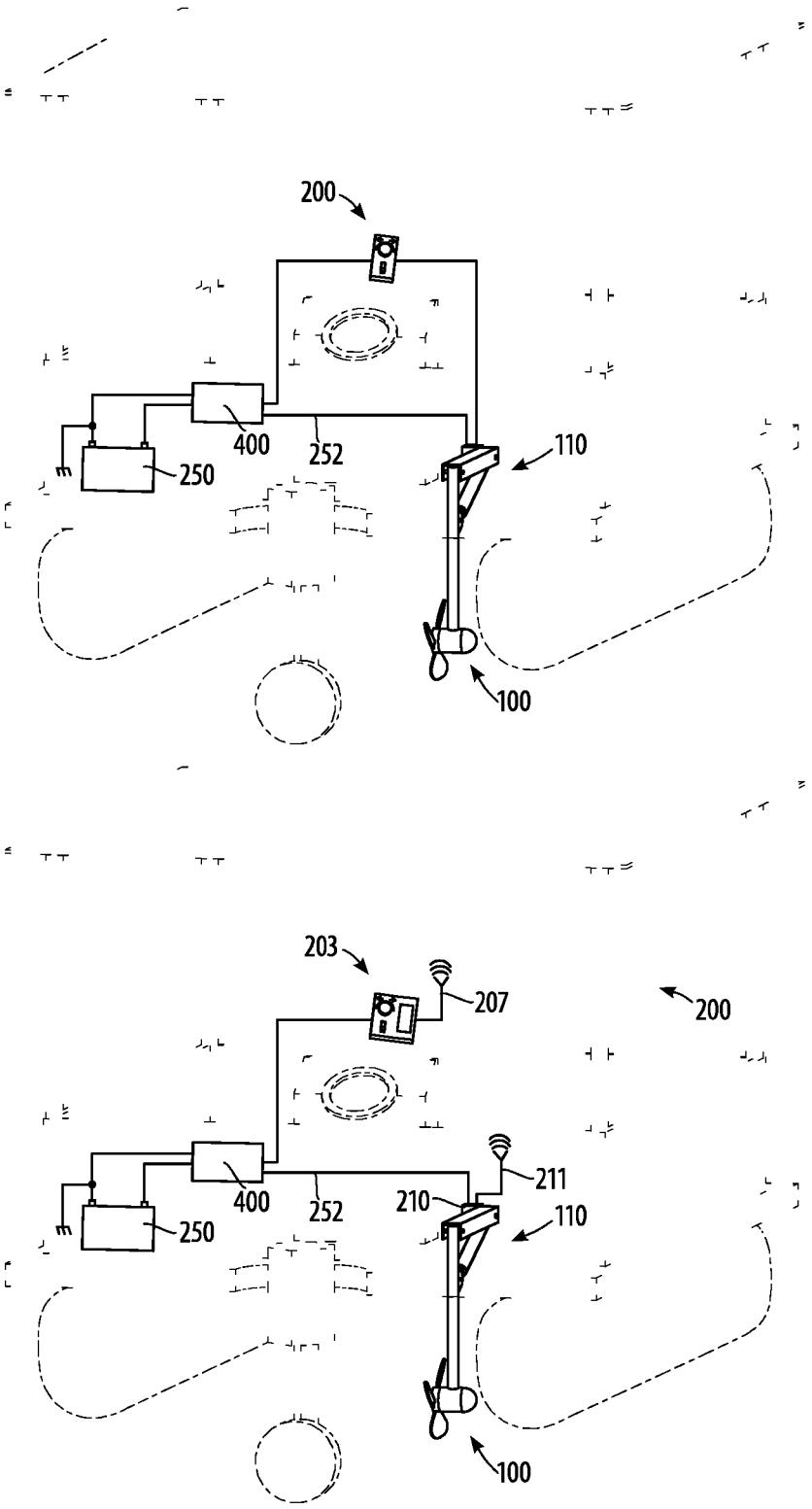
FIG. 2 is a schematic view of a lowered thruster assembly and its control.
Figure 3:
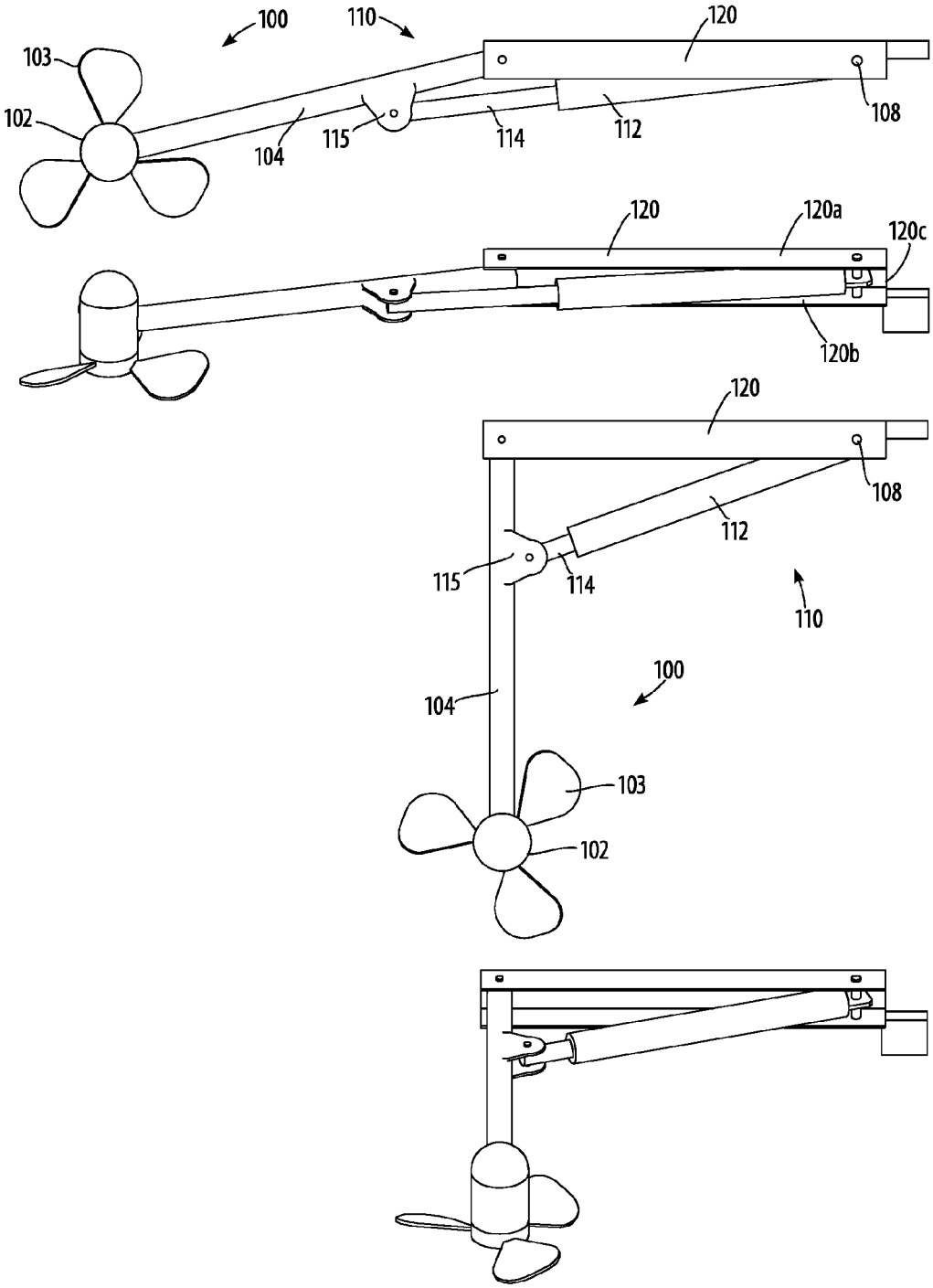
FIG. 3 is side and isometric views of the thruster assembly.

Before the present invention(s) is described in further detail, it is to be understood that the invention(s) is not limited to the particular embodiments described, and as such may, of course, vary. It is also to be understood that the terminology used herein is for the purpose of describing particular embodiments only, and is not intended to be limiting, since the scope of the present invention(s) will be limited only by the appended claims.

Unless defined otherwise, all technical and scientific terms used herein have the same meaning as commonly understood by one of ordinary skill in the art to which this invention(s) belongs. Although any methods and materials similar or equivalent to those described herein can also be used in the practice or testing of the present invention(s), a limited number of the exemplary methods and materials are described herein. It must be noted that as used herein and in the appended claims, the singular forms "a", "an", and "the" include plural referents unless the context clearly dictates otherwise. All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention(s) is not entitled to antedate such publication by virtue of prior invention(s). Further, the dates of publication provided may be different from the actual publication dates, which may need to be independently confirmed.

The retractable thruster system according to the present invention broadly comprises a thruster assembly 100, which includes a thruster 102 mounted to one end of an elongated motor tube 104. At its opposite end, the motor tube 104 is secured to a hull mounting member 120, which is attached to, and extends longitudinally along, a bottom of a vessel hull. An actuator assembly 110 having an actuator 112 is operationally connected to the thruster assembly 100 and is configured to control operation of the thruster assembly 100. The actuator assembly 110 is secured to the hull mounting member 120 adjacent the thruster assembly 100.

The motor tube 104 is configured for a pivotal movement about a pivot pin 108, pivoting between a normally retracted position and an operationally extended position, when the motor tube 104 extends substantially perpendicularly to the hull mounting member 120.

The hull mounting member 120 can be formed by two (2) parallel beams 120*a* and 120*b* connected by a transverse beam 120*c*, which extends between the parallel beams 120*a* and 120*b* at a substantially the right angle. Of course, the hull mounting member 120 may be configured in various ways or may comprise separate brackets for mounting the actuator assembly 110 or thruster assembly 100 and may be formed of various dimensions, shapes, and materials.

The thruster assembly 104 is connected to a power source 250 by suitable electrical wiring 252. A propeller 103 is mounted on a distant end of the motor tube 104. The power source 250 supplies motive power to the propeller 103 during operation of the thruster assembly, causing 360-degree rotation of the propeller 103 during operation of the thruster assembly. In the preferred embodiment the power supply 250 is a standard battery, but may include a generator, motor, turbine, or other electric generating device. The electrical wiring or power cord 252 can be a standard cord used to conduct electricity and is durable enough to withstand being submerged in water for a considerable amount of time without malfunction. In an alternate embodiment the power supply 250 can be connected to a variable power regulator 400, which is configured to control the amount of power being supplied to the actuator 112.

It is envisioned that the thruster 102 may be a standard trolling motor. However, other alternative thrusters are contemplated, such as water-jet thrusters, twin propeller thrusters, rudder propeller thrusters, azimuth thrusters, and so forth. The particular thruster selected depends on several factors such as type of vessel, specific purpose of the auxiliary thruster, cost, and various other factors and such thruster type is not meant to limit the instant invention.

The actuator assembly 110 is operationally connected to the motor tube 104 via the actuator 112 and an actuator output arm 114 to impart pivotal movement on the motor tube 104. An actuator arm bracket 115 secures the motor tube 104 to the actuator output arm 114. The actuator output arm 114 is configured to telescopically coaxially extend from the actuator 112 and push or pull the motor tube 104 for movement between extended and retracted positions, respectively.

The actuator 112 is affixed to the hull mounting member 120 at an end distant from the actuator output arm 114 by a securing bracket. The actuator 112 may be hydraulic, pneumatic, electrical, electro/magnetic, or powered rack and pinion.

In a preferred embodiment the motor tube 104 is comprised of an elongate tubular housing which encases a control cable. In some of the embodiments, the motor tube 104 can be a hollow tube having the length of between 20 inches and 25 inches, and a diameter between 3 inches and 5 inches. Of course, the specific dimensions of the motor tube 104 can vary according to multiple factors such as cost, durability, the size of the watercraft, etc. A relatively short motor tube 104 is preferred as to prevent drag on the propulsion of the boat, debris build up, and damage to the thruster assembly 100. The motor tube 104 may be formed of metal, plastic, composite material, or other suitable durable noncorrosive material.

Figure 4:
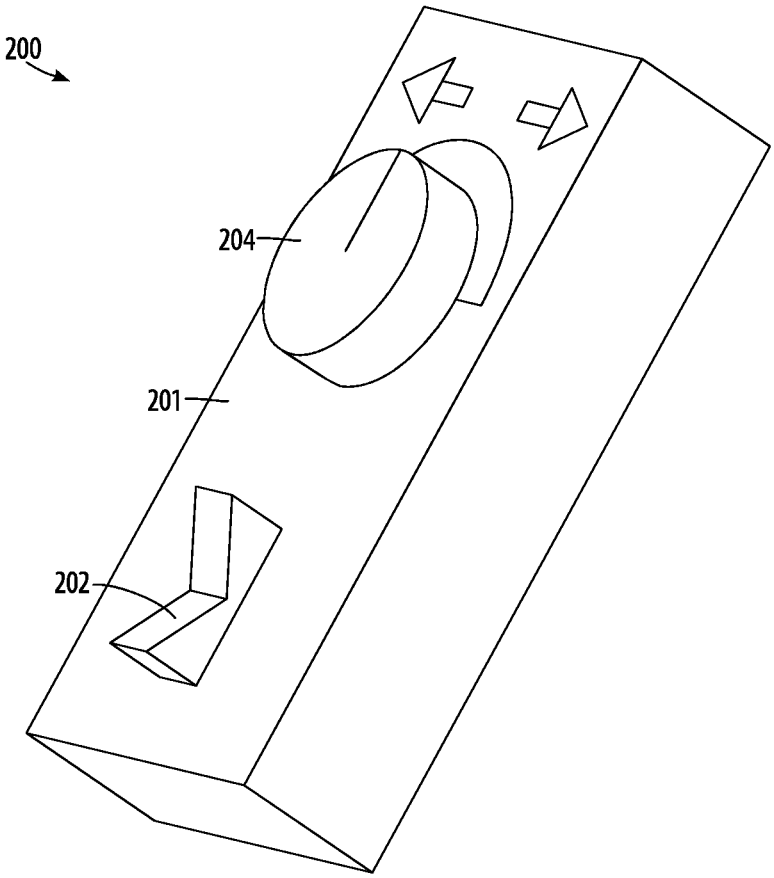
FIG. 4 is a schematic view of a first embodiment of a control unit according to the present invention.

The system of the present invention comprises a deck-mounted control unit 200 to allow activation and de-activation of the actuator assembly 110 and the thruster assembly 100 from the boat deck. In one embodiment, schematically shown in FIG. 4, a control panel 201 has an actuator switch 202 operationally connected to the actuator 112 and a thruster rotation knob 204 configured to control rotation of the propeller 103 and the thruster 102. The control unit 200 is connected to the actuator assembly 110 and the thruster assembly 110 by suitable electrical wiring.

Figure 5:
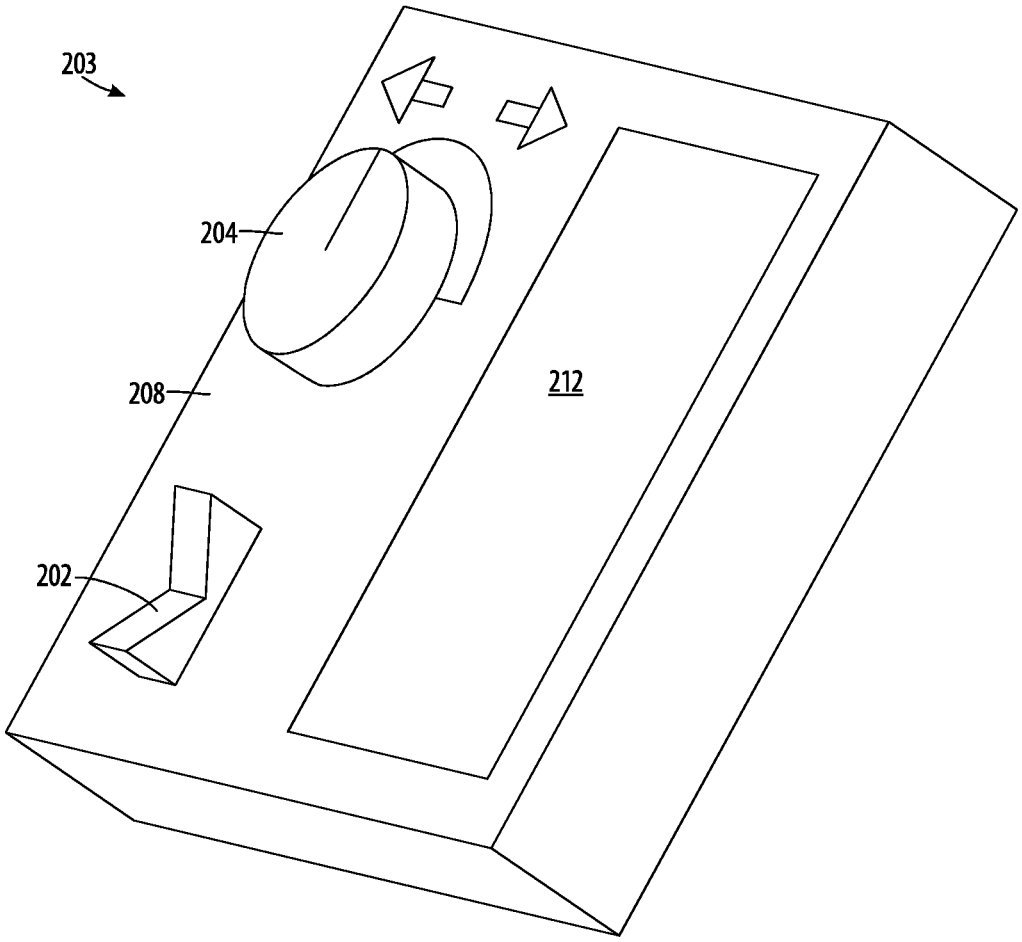
FIG. 5 is a schematic view of a second embodiment of a control unit.

In another embodiment, schematically shown in FIG. 5, the control unit 203 uses wireless communication for operation of the thruster assembly and the actuator assembly. The alternative control unit 203 comprises a wireless control panel 208 and wireless communication receiving device 210. The wireless control panel 208 may include a digital user interface 212, which displays the operational conditions of the system. An actuator switch 202 and the thruster rotation knob 204 may be similar to the first embodiment of the control unit 200. An antenna 207 built into the control unit 203 is configured to send signals to the receiving device 210, which is equipped with a receiving antenna 211.

The digital user interface 212 may be a touch screen control capable of receiving instructions from a user and transmitting the control signals via the antenna 207 to the receiving unit 210. The wireless control unit 203, similar to the hard-wired control unit 200, is configured to control pivotal and rotational movement of the thruster assembly 100, rotational movement of the propeller 103, as well as the extension and retraction of the motor tube 104 using the actuator assembly 110.

It is envisioned that the rotational position of the thruster 104, while in service, may be regulated by other devices, such as for instance, without limitation, a joy stick, digital control, touch screen control, or other technology remotely used for communication with an electrical device. Furthermore, the control unit may include radio, electromagnetic devices, Wi-Fi, Bluetooth, cellular, Wimax, etc.

Figure 6:
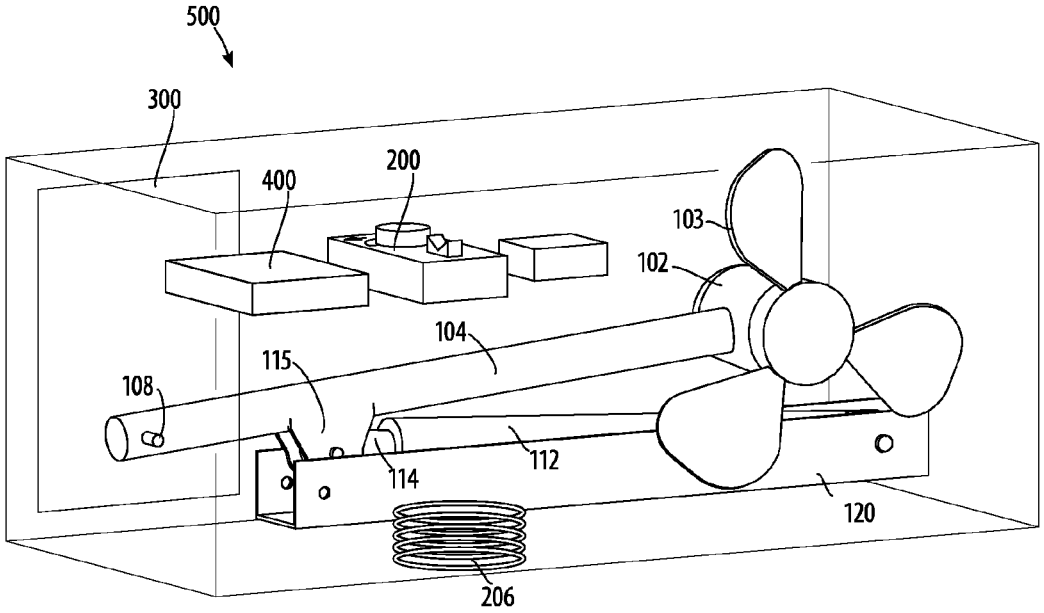
FIG. 6 is a schematic view of a boat retrofitting kit according to the present invention.

FIG. 6 schematically illustrates a retrofitting kit 500 according to the present invention. The retrofitting kit comprises the thruster 102, motor tube 104, pivot pin 108, actuator 112, actuator output arm 114, actuator arm bracket 115 and associated securing elements, the control unit 200 along with the electrical wiring 206, the hull mounting member 120, a variable power regulator 400, an owner's manual 300, and all necessary bolts, screws, etc. for mounting the auxiliary thruster system of the present invention to the hull of the boat.

One of the important advantages of the hull-mounted retractable thruster system according to this invention is the ease to which the thruster is deployed for service. As illustrated in FIG. 1, in operation, during times when the thruster is not needed, the thruster assembly 100 is in a retracted position under the vessel and above the water. In the retracted position of the thruster assembly 100, the actuator output arm 114 is in an extended position from the actuator 112. When port or starboard thrust is needed, the operator of the vessel can activate the actuator switch 202 on the control unit 200, 203. The control unit 200, 203 signals the actuator to pull the actuator output arm 114 back toward the actuator 112. This pulling acts upon the actuator arm bracket 115 attached to the motor tube 104, which then pivots about the pivot pin 108, pulling the motor tube 104 into an essentially vertical position, putting the thruster assembly 100 into the water at enough depth to clear the pontoons. Then the operator can manipulate the thruster rotation knob 204 to control the port-starboard direction and the speed of the thruster 102 and the propeller 103. When the thruster is again not needed, the operator can activate the actuator switch 202 again, which signals the actuator 112 to extend the actuator output arm 114, pushing and pivoting the actuator arm bracket 115, the motor tube 104, and the thruster assembly 100 into a retracted position under the vessel and above the water.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Many changes and modifications can be made in the present invention without departing from the spirit thereof. I therefore pray that my rights to the present invention be limited only by the scope of the appended claims.

I claim:

1. A retractable thruster system for ships, comprising:

(i) a thruster assembly engageably mounted to the hull of a vessel to maneuver the vessel in direction and speed;

(ii) an actuator assembly mounted to the hull of the vessel operationally connected to said thruster assembly and configured to engage the thruster assembly in protracting and retracting the thruster assembly; and (iii) a control panel operationally connected to the actuator and thruster assembly with a means of commanding speed and direction of said vessel through the thruster assembly and protraction and retraction of the thruster through control of the actuator;

wherein the thruster assembly comprises a thruster and a motor tube operationally secured to the hull of a vessel by securing means;

wherein said thruster system further comprises a pivot rod engaging and securing means and operationally securing said thruster assembly to said vessel hull, allowing for rotation of the thruster assembly;

wherein the pivot rod operationally engages the motor tube and fastens the motor tube to said hull of said vessel through securing means; and wherein the securing means is a bracket.

2. A retractable thruster system for ships, comprising:

(i) a thruster assembly engageably mounted to the hull of a vessel to maneuver the vessel in direction and speed;

(ii) an actuator assembly mounted to the hull of the vessel operationally connected to said thruster assembly and configured to engage the thruster assembly in protracting and retracting the thruster assembly; and (iii) a control panel operationally connected to the actuator and thruster assembly with a means of commanding speed and direction of said vessel through the thruster assembly and protraction and retraction of the thruster through control of the actuator;

wherein said actuator assembly further comprises an actuator operationally connected to an actuator output arm;

wherein said retractable thruster system further comprises securing housing and securing members operationally connecting the actuator output arm and motor tube; and wherein the securing housing comprises a bracket.

3. A retractable thruster system for ships, comprising:

(i) a thruster assembly engageably mounted to the hull of a vessel to maneuver the vessel in direction and speed;

(ii) an actuator assembly mounted to the hull of the vessel operationally connected to said thruster assembly and configured to engage the thruster assembly in protracting and retracting the thruster assembly; and (iii) a control panel operationally connected to the actuator and thruster assembly with a means of commanding speed and direction of said vessel through the thruster assembly and protraction and retraction of the thruster through control of the actuator;

wherein the control panel further comprises housing to hold a means to engage the actuator and means for rotating the thruster;

wherein said retractable thruster system further comprises a power supply and power cord operationally connected to said actuator assembly and thruster assembly; and wherein the power supply is a standard battery able to provide adequate power to said thruster and said actuator.

4. The invention of claim 3, wherein a digital maximizer is attached to the power supply to create efficiency for said power supply.

5. A kit for assembling a method and system of protracting and retracting a thruster from the hull of a vessel, the kit comprising:

(i) a thruster assembly comprising a thruster to be secured to a motor tube;

(ii) a motor tube to be secured to the hull of a vessel through a pivot rod;

(iii) a pivot rod securing the motor tube to a securing means;

(iv) a securing means for attaching the thruster assembly to the hull of a vessel;

(v) an actuator assembly comprising an actuator with actuator arm, means of securing the actuator to the hull of a vessel, securing means for securing the actuator arm to the motor tube, a control cable connected to a control panel at the first end and connected to the actuator at the second end, a control panel to direct the functionality of the actuator and thruster, a digital maximizer to regulate the power from a power source.

6. The kit of claim 5, wherein said means for securing the thruster to the motor tube comprises a plurality of nuts and bolts configured to be secured to the first end of the motor tube.

7. The kit of claim 6, wherein said means of securing the motor tube to the hull of a vessel comprises securing the second end of the motor tube to a pivot rod engaged with a bracket which is fastened to the hull of the vessel.

8. The kit of claim 5, further comprising an instruction manual for constructing the retractable thruster system.

* * * * *